United States Patent [19]

Boscaro et al.

[11] 4,363,657

[45] Dec. 14, 1982

[54] PROCESS FOR OBTAINING MANGANESE- AND SILICON-BASED ALLOYS BY SILICO-THERMAL MEANS IN A LADLE

[75] Inventors: Louis Boscaro, Aiguebelle; Michel Demange, Le Fayet; Jean-Philippe Bucher, Aiguebelle; Francis Dubrous; Louis Septier, both of Le Fayet, all of France

[73] Assignee: Societe Francaise d'Electrometallurgie Sofrem, Paris, France

[21] Appl. No.: 253,521

[22] PCT Filed: Jul. 15, 1980

[86] PCT No.: PCT/FR80/00121

§ 371 Date: Mar. 6, 1981

§ 102(e) Date: Mar. 6, 1981

[87] PCT Pub. No.: WO81/00262

PCT Pub. Date: Feb. 5, 1981

[30] Foreign Application Priority Data

Jul. 17, 1979 [FR] France ..... 79 18985

[51] Int. Cl.[3] ..... C22B 47/00; C22C 28/00

[52] U.S. Cl. ..... 75/80; 75/89; 75/90 R; 420/434

[58] Field of Search ..... 75/80, 134 M, 134 S, 75/89, 90 R, 133

[56] References Cited

U.S. PATENT DOCUMENTS

| | | | |
|---|---|---|---|
| 2,810,639 | 10/1957 | Kessler | 75/134 S |
| 3,329,497 | 7/1967 | Deadrick et al. | 75/80 X |
| 3,347,664 | 3/1965 | Bauer, Jr. et al. | 75/133 |

FOREIGN PATENT DOCUMENTS

| | | | |
|---|---|---|---|
| 1270822 | 6/1968 | Fed. Rep. of Germany | 75/134 S |
| 755939 | 12/1933 | France . | |
| 761460 | 3/1934 | France . | |
| 762928 | 4/1934 | France . | |
| 780125 | 4/1935 | France . | |
| 830064 | 7/1938 | France . | |
| 843661 | 7/1939 | France . | |
| 1321508 | 12/1963 | France . | |
| 2443510 | 8/1980 | France | 75/134 S |
| 486072 | 12/1976 | U.S.S.R. | 75/134 S |

*Primary Examiner*—L. Dewayne Rutledge
*Assistant Examiner*—David A. Hey
*Attorney, Agent, or Firm*—McDougall, Hersh & Scott

[57] ABSTRACT

The invention relates to a process for obtaining manganese- and silicon-based alloys by silico-thermal means in a ladle.

An oxidized liquid slag, usually originating from earlier metallurgical operations and still containing from 10 to 40% of manganese in the form of MnO is treated by a silicon-based reducing alloy (silicon content of at least 60% and preferably at least 70%) with agitation.

A slag which is substantially exhausted of manganese and a metal containing more than 60% and generally more than 70% of manganese and from 5 to 40% and preferably from 10 to 35% of silicon are thus obtained.

16 Claims, No Drawings

PROCESS FOR OBTAINING MANGANESE- AND SILICON-BASED ALLOYS BY SILICO-THERMAL MEANS IN A LADLE

The present invention relates to a process for obtaining manganese- and silicon-based alloys by silicothermia.

It is known to manufacture manganese-based alloys such as ferromanganeses having a low carbon content of from 0.02 to 2% (so-called "overrefined" and "refined" ferromanganeses) by a silico-thermal reaction between a liquid phase, obtained by the reducing fusion of a manganese ore and lime, and a silico-manganese containing from 10 to 45% of silicon. Although the manufacture of these silico-manganeses having an average silicon content is relatively simple, their use is accompanied by several disadvantages. In particular, if the silico-manganese is manufactured in advance and stored in the solid state, for example during periods of the year when hydro-electric power is abundant, it is necessary to remelt from 1.2 to 9 tons of ballast constituted by the alloying elements (iron+manganese) per tons of useful silicon at the time of use.

A process for the silico-thermal reduction of manganese ore has been described, in particular, in U.S. Pat. No. 3,347,664 (assigned to Union Carbide). In that process, and in numerous similar processes in which a molten mixture of manganese ore and lime is treated with a silicon-based reducing agent, a non-exhausted slag whose manganese content can be as high as from 20 to 25% if carrying out silico-thermia and from 30 to 35% if carbonized ferro-manganese (containing from 6 to 8% of C) is produced by carbothermia, is obtained in addition to the metal. At present, these slags are cooled in ingot-molds, stored are retreated by electric furnace carbothermia at a later stage, giving an almost exhausted slag (less than 6% of Mn) and a silico-manganese whose Si content can range from 10 to 45% and which is reintroduced into a silico-thermia cycle. However, the substantial amount of heat contained in the liquid slag rich in Mn is all lost in this procedure and, moreover, a special furnace has to be set aside for the carbo-thermal exhaustion of this slag.

The main object of the process forming the subject of the present invention is to recover the manganese present in non-exhausted slags and to obtain a manganese-based alloy containing at least 60% and preferably at least 70% of manganese, the remainder being iron, silicon in a content of between 5 and 40% and preferably between 10 and 35% and the normal impurities: aluminum, calcium, carbon, sulphur, phosphorus in a total content not exceeding 5% and usually far below this value.

This process involves the following stages:

(a) The starting material is a liquid slag containing from 10 to 40%, and usually from 20 to 35%, of manganese in oxide form, having a valency of approximately 2.

(b) A silicon-based reducing alloy containing more than 60% and preferably more than 70% of silicon is added to the liquid slag.

(c) The liquid slag and the reducing alloy are brought into contact by agitation.

(d) A liquid slag which is substantially exhausted of manganese, on the one hand, and a metal having a manganese content of at least 60% and usually above 70% and a silicon content of between 5 and 40% and preferably between 10 and 35%, on the other hand, are separated by decantation.

The liquid slag may originate, in particular, from the reaction between a molten mixture of manganese ore and lime on the one hand and a silicon-based reducing alloy on the other hand, this alloy generally being a silico-manganese containing from 10 to 45% of silicon. The liquid slag which is generally called "non-exhausted slag" can contain from 10 to 40% and usually from 20 to 35% of manganese in a form similar to MnO. The other constituents of the slag are, in addition to the lime added as flux, alumina, silica and usually magnesia. The following typical composition can be given as a non-limiting example:

MnO—26–34%
FeO—1–1.5%
MgO—2–3.5%
$Al_2O_3$—4–6%
$SiO_2$—24–26%
CaO—28–32%

The silicon content of the reducing alloy should be at least 60% and preferably at least 70%. It can be as high as 98 to 99% in some cases. The remainder can be constituted essentially by iron, in which case it is a "ferrosilicon" or by manganese, in which case it is a so-called high-grade "silico-manganese". A silico-manganese having a high silicon content of this type can be obtained by various known methods and, in particular, by simultaneous fusion or mixing in the molten state of at least two metals or alloys which provide the elements needed for the desired composition.

For example, by fusion of one ton of ferrosilicon having the following composition, by weight:

Si—98%
Fe—0.5%
misc.—1.5% (Ca, Al)

and 380 kg of refined ferromanganese having the following composition by weight:

Mn—82.1%
Fe—15.9%
misc.—2.0% a "high grade" silico-manganese having the following composition by weight is obtained:

Si—71.0%
Mn—22.6%
Fe—4.7%
misc.—1.6%.

Another process involves reducing the oxidized compounds of at least one of the two main elements of the alloy in a known manner, for example in an electric furnace.

The liquid slag and the reducing alloy can be brought into contact by any known method of agitation such as the so-called "Ugine-Perrin process" which involves successive pouring from ladle to ladle and is described, in particular, in French Pat. Nos. 755 939, 761 460, 762 928, 780 125, 830 064, 843 661, or again by insufflation of a gas, for example air or inert gas through a single or double flow nozzle merging into the lower portion of the ladle in which the slag and the reducing agent have been introduced, or again in a shaking ladle, or by any other equivalent method.

When using a double flow nozzle, the air or inert gas is preferably injected through the central portion and a protecting gas through the annular portion.

If stirring is effected by pouring from a first ladle into a previously heated second ladle, the reducing alloy can be introduced either in the first ladle or at the moment of pouring into the second ladle for the first time.

The following examples serve to illustrate various embodiments of the invention.

EXAMPLE 1

1000 kg of non-exhausted liquid slag originating from the manufacture of refined ferromanganese and containing 22.9% of manganese were poured into a ladle lined with tarred magnesia and provided laterally at its base with a 6 mm bore nozzle. At the same time 225 kg of a solid "high-grade" silicon-manganese alloy in particles of from approximately 2 to 10 mm and containing 65.9% of silicon and 27.8% of manganese were poured into the same ladle.

Some air was blown through the nozzle at a flow-rate of 26 Nm3/hr.

The resulting agitation was maintained for 12 minutes.

A slag containing only 2.3% of manganese and 330 kg of silico-manganese containing 21.8% of silicon and 75.6% of manganese were separated by decantation. These results are quite comparable to those normally obtained in the electric furnace carbothermal reduction of the same ferromanganese slags, but they were obtained directly from these liquid slags without the need to cool them and crush them, then to remelt them.

In this example, the agitation and the contact between the liquid and solid phases, achieved by blowing air in a nozzle, could have been produced with an identical result by conventional methods such as pouring from ladle to ladle a, shaking ladle or a, mechanical agitator.

EXAMPLE 2

1000 kg of liquid slag originating from the manufacture of refined ferromanganese and containing 23.1% of manganese and 190 kg of a solid silicon-manganese alloy in particles of from about 2 to 10 mm and containing 71% of silicon, 25% of manganese, 0.1% of carbon and 3.9% of iron and miscellaneous substances (calcium, aluminium, sulphur, phosphorus . . .) were introduced into a ladle lined with tarred magnesia.

The mixture was then poured into an identical second ladle which had previously been heated by a gas burner and was subsequently poured back into the first ladle to ensure thorough mixing of the products.

A substantially exhausted slag containing 2.2% of Mn on the one hand and 340 kg of silico-manganese containing 22% of silicon and 74.6% of manganese on the other hand were obtained by decantation, the other constituents being essentially iron (3.1%) and various minor impurities (aluminium, calcium, sulphur, phosphorus, carbon).

The carbon content, for example, is less than 0.10%.

EXAMPLE 3

1000 kg of liquid slag originating from the manufacture of refined ferromanganese containing 23.1% of manganese and, at the same time, 275 kg of a silico-manganese containing 71% of silicon and 25% of manganese crushed to particles of from 2 to 10 mm were poured into the same ladle as in Example 1, provided with a lateral nozzle.

Some air was blown through the nozzle for 12 minutes at a flow rate of 26 Nm3/hr so as to maintain intense agitation and bring the two phases into contact.

A slag containing no more than 2.0% of manganese and 425 kg of silico-manganese containing 31.2% of silicon, 66.2% of manganese, 2.6% of iron and less than 0.03% of carbon were separated by decantation.

EXAMPLE 4

1000 kg of slag containing 24.0% of manganese, as well as 192 kg of "ferrosilicon 75" containing 74.4% of silicon were poured into the same ladle as in Examples 1 and 3, provided with a lateral nozzle. Some air was blown through the nozzle for 12 minutes at a flow rate of 26 Nm3/hr to maintain intense agitation and bring the two phases into contact.

A slag containing only 2.5% of Mn, on the one hand, and 340 kg of silico-manganese containing 23.2% of silicon, 62.5% of manganese, 14.1% of iron and less than 0.10% of carbon were separated by decantation.

EXAMPLE 5

1000 kg of slag containing 25.4% of manganese was treated in the same ladle and under the same conditions as in Examples 1, 3 and 4 with 180 kg of silicon containing 98.5% of Si and 0.55% of Fe, crushed into particles of from 2 to 10 mm.

A slag containing 2.1% of manganese, on the one hand, and 345 kg of silico-manganese containing 31.8% of silicon, 67.1% of manganese, 0.8% of iron and less than 0.03% of carbon was obtained and separated by decantation.

The manganese-based alloys manufactured by the process forming the subject of the invention can either be used as addition alloys or be introduced into the cycles of silico-thermal operations leading to particular types of manganese alloys which are difficult or impossible to obtain by other processes.

We claim:

1. A process for obtaining a manganese-based alloy by silico-thermia in a ladle from a heated oxidized slag containing manganese oxide comprising:
   (a) introducing the heated oxidized slag, containing from 10 to 40% manganese oxide with the manganese being present essentially in the divalent state, into the ladle;
   (b) introducing a crushed solid silicon-based reducing alloy, containing more than 60% silicon, into the ladle;
   (c) contacting the heated oxidized slag and the silicon-based reducing alloy with agitation to exothermically reduce the oxidized slag without the further application of heat from an external source;
   (d) separating a slag which is substantially free of manganese from a metal having a manganese content of at least 60% and a silicon content within the range of 5 and 40% by decantation.

2. A process according to claim 1 wherein the oxidized slag is formed during the manufacture of ferromanganese, by silico-thermia of a molten mixture of manganese ore and flux, said molten mixture essentially containing manganese oxide, lime, silica, alumina and magnesia.

3. A process according to claim 1 wherein the reducing alloy is a silicon-manganese alloy containing more than 60% silicon, from 10 to 40% manganese plus iron and impurities including calcium, aluminum, carbon, sulphur and phosphorus in an amount not greater than 5%.

4. A process according to claim 1 wherein the reducing alloy is a ferro-silicon alloy containing more than 60% silicon, from 10 to 40% iron and impurities including manganese, calcium, aluminum, carbon, sulphur and phosphorus in an amount not greater than 5%.

5. A process according to claim 1 wherein the reducing alloy is silicon metal having a silicon content of at least 96%.

6. A process according to claim 1 wherein agitation is effected by pouring the oxidized slag and the reducing alloy at least once from a first ladle into a second ladle which has been previously heated.

7. A process according to claim 1 wherein the agitation is effected by pouring the oxidized slag at least once from a first ladle into a second ladle which has been previously heated and wherein the reducing alloy is added to the oxidized slag during the first pouring.

8. A process according to claim 1 wherein the agitation is effected by injecting a gas under pressure through the lower portion of the ladle.

9. A process according to claim 7 wherein the gas is injected under pressure through a single-flow nozzle, said gas comprising air or an inert gas.

10. A process according to claim 7 wherein the gas is injected under pressure through a double-flow nozzle having a central portion for flow of the gas and an annular portion for flow of a protecting gas.

11. A process according to claim 1 wherein the oxidized slag contains from 20 to 35% manganese oxide with the manganese being present essentially in the divalent state.

12. A process according to claim 1 wherein the silicon-based reducing alloy contains more than 70% silicon.

13. A process according to claim 1 wherein the metal has a manganese content of at least 70% and a silicon content within the range of 10 and 35%.

14. A process according to claim 1 wherein the reducing alloy is a silicon-manganese alloy containing more than 70% silicon, from 10 to 30% manganese plus iron and impurities including calcium, aluminum, carbon, sulphur and phosphorus in an amount not greater than 5%.

15. A process according to claim 1 wherein the reducing alloy is a ferro-silicon alloy containing more than 70% silicon, from 10 to 30% iron and impurities including manganese, calcium, aluminum, carbon, sulphur and phosphorus in an amount not greater than 5%.

16. A process according to claim 5 wherein the reducing alloy is silicon metal having a silicon content of at least 98%.

* * * * *